US006451126B1

(12) United States Patent
Mattix

(10) Patent No.: US 6,451,126 B1
(45) Date of Patent: Sep. 17, 2002

(54) METHOD FOR CLEANING THE MACHINE FRAMES OF A PULP PAPER PROCESSING DRYER

(76) Inventor: Walter Mattix, 2813 Pahokee Trace, Birmingham, AL (US) 35243

( * ) Notice: Subject to any disclaimer, the term of this patent is extended or adjusted under 35 U.S.C. 154(b) by 0 days.

(21) Appl. No.: 09/412,853

(22) Filed: Oct. 5, 1999

(51) Int. Cl.[7] ..... B08B 3/00; B08B 3/02; B08B 3/04; B08B 3/10

(52) U.S. Cl. ..... 134/36; 134/26; 134/30; 134/95.3; 134/199

(58) Field of Search ..... 134/26, 30, 36, 134/95.2, 95.3, 198, 199

(56) References Cited

U.S. PATENT DOCUMENTS 3,675,665 A 7/1972 Sadwith
3,675,849 A 7/1972 Boylan
3,846,986 A 11/1974 Anderson
4,760,857 A * 8/1988 Shiba et al. ..... 134/144
5,004,156 A * 4/1991 Montanier ..... 239/130
5,657,781 A 8/1997 Steverson
5,964,960 A * 10/1999 Boeck ..... 134/34

* cited by examiner

*Primary Examiner*—Zeinab El-Arini

(57) ABSTRACT

The present invention provides a method of cleaning a plurality of machine frames including the steps of positioning a plurality of directional nozzles near and oriented toward the surface of the machine frames at selected heights relative thereto and simultaneously and continuously spraying a cleaning solution from the directional nozzles onto the machine frames. The present invention further includes rinsing the machine frames by spraying water from the directional nozzles onto the machine frames, and allowing the machine frames to dry. In the preferred embodiment of the present invention, the cleaning solution and water are heated, and sprayed onto the machine frames at a varying flow rate and spray pattern to allow for a more complete application of the cleaning solution and water onto the machine frames. The present invention provides a more thorough and efficient method of cleaning the machine frames of a pulp paper processing dryers, which enhances the safety and capacity utilization of pulp and paper mills.

8 Claims, 3 Drawing Sheets

METHOD FOR CLEANING THE MACHINE FRAMES OF A PULP PAPER PROCESSING DRYER

BACKGROUND AND SUMMARY OF INVENTION

The present invention relates to a system and method for cleaning a pulp paper processing dryer, and more specifically an apparatus and method for automatically cleaning the machine frames of a pulp paper processing dryer utilizing a plurality of directional nozzles positioned adjacent to the machine frames, means for pumping cleaning solution to the directional nozzles for application onto the machine frames, means for selectively communicating cleaning solution between the pumping means and the directional nozzles, and means for automatically controlling the operation of the cleaning system.

The operation of the dryer section of a pulp and paper mill utilizing a wet process wherein paper is manufactured by continuous sheet forming and drying is critical to the economic viability of a pulp and paper mill. The dryer section of a pulp and paper manufacturing plant is often the production bottleneck. In the increasingly competitive pulp and paper industry, where margins are tight, more emphasis is being placed on the importance of achieving a high capacity utilization of the dryer section to allow a manufacturing facility an opportunity to meet production goals. Within the pulp and paper industry there is a vital need to improve the efficiency of every aspect of operating the pulp paper processing dryer while maintaining high standards for worker safety.

Paper is typically manufactured from a dilute mixture of paper fibers and water. Water is removed from this dilute mixture in three basic steps; including 1) screening or forming wherein the dilute mixture is passed through fine screens to form a sheet of wet paper fibers, 2) removing water from the wet sheet by mechanical means utilizing a series of press rolls, and, 3) removing additional water by evaporative drying utilizing a series of drying rolls heated internally by steam. Although each of these basic steps involves the removal of water, the dryer section of a pulp and paper mill refers to the later step wherein a continuous paper web is dried as it passes over a series of heated rolls before the final dried paper product is wound onto reels. The dryer section is comprised of a complex series of large spinning cylindrical dryer cans over which the paper web travels. On each side of the dryer cans are machine frames that support the dryer cans. Dryer sections are often operated within a protective enclosure that contains heat released during the drying process allowing for lower energy consumption by the drying process. The protective enclosure, or dryer hood, remains closed when the dryer is operating. When the dryer is out of service, large doors in the dryer hood are opened to allow access to and inspection of the dryers.

Because of economic pressures it has become vital for a pulp and paper mill to improve the efficiency of every aspect of the operation of pulp processing dryers. An important but often overlooked operational aspect of these machines is the process by which the pulp paper processing dryers are cleaned. In particular, the machine frames of a pulp and paper processing dryer must be routinely cleaned to remove oil, grease, and paper fines that accumulate thereon during operation of the equipment. Keeping the machine frames of a pulp paper dryer clean of accumulated oil, grease, and paper fines is important to maintain a safe work environment and to reduce the risk of a fire, which could injure workers and destroy operating equipment causing a reduction in the facility's capacity utilization. Another important benefit of frequent cleaning of machine frames is the removal of paper fines from the dryer section of a pulp paper mill that could otherwise contaminate, and reduce the quality of, the mill's paper products.

Although there is an overriding need to improve the efficiency of every aspect of the pulp processing dryer cleaning process, the industry continues to rely on time-consuming and inefficient methods for cleaning pulp paper processing dryers. The conventional method of cleaning the machine frames of pulp and paper dryers is labor intensive. A small portable tank of cleaning solution and a small portable cleaning solution pump are positioned near a machine frame to be cleaned. Plant personnel connect the hose and spray nozzle to the cleaning solution pump, then spray cleaning solution onto the machine frames. After the cleaning solution is left on the machine frames for a period of time, the hose and spray nozzle is connected to a source of water and water is then sprayed on the surface of the machine frames to rinse off cleaning solution, oil and grease. The primary drawback of the conventional cleaning method is its time-consuming nature. Dryer sections of pulp and paper mills can be very large, having lengths in excess of 300 hundred feet, and these sections contain a large number of machine frames. A cleaning method that requires a person to clean each of the many machine frames in succession is a lengthy process, one that often cannot be completed during a short period of time.

For most pulp and paper mills it is important to minimize the periods that its dryer section is not in service. When a dryer has been taken out of service, many tasks must be performed to place the equipment back in service, and to minimize downtime these tasks must be completed as efficiently as possible. Unfortunately, during these downtimes manpower is often at a premium. In some cases, pulp and paper dryers normally cannot be cleaned after maintenance work on the dryer has begun. As a general rule, pulp and paper dryers can be cleaned using conventional methods only when there are no significant limitations on both the time available for cleaning and the manpower available to clean.

Under these constraints, it is not unusual for the portions of the equipment to be cleaned most frequently to be the most visible, easiest ones. More difficult sections are typically cleaned less frequently, such as the side of the machine frames facing the dryer cans (i.e., back sides of the machine frames). The back sides of the machine frames are seldom cleaned because of the difficulty involved in cleaning these sections utilizing the conventional cleaning method. A conventional method of cleaning the back sides of machine frames is to stand on a walkway above the machine frames and spray cleaning solution downward onto the back sides of the machine frames. This task cannot be performed for several hours after the dryer section has been taken out of service because of unsafe high temperatures. Plant personnel cannot clean the back sides of the machine frames until the dryer section has sufficiently cooled. This delay in commencing this work causes the work to be performed infrequently, if at all. Cleaning machine frames utilizing a more efficient cleaning method would result in more frequent and more thorough cleaning of machine frames and would result in a safer work environment and a reduced risk of property damage from a fire caused, in part, by the accumulation of oil, grease, and paper fines on machine frames.

Another problem with the conventional cleaning method is that all machine frames are cleaned in succession, and all machine frames cannot be cleaned simultaneously soon after a pulp and paper processing dryer has been taken out of operation. It would be advantageous to clean all machine frames shortly after the machines have been taken out of operation before the machines and the oil, grease, and paper fines accumulated thereon have cooled down. A more efficient cleaning method that allowed for the simultaneously cleaning of all machine frames before the machine frames have cooled down would be a significant improvement over conventional cleaning methods.

SUMMARY OF THE PRESENT INVENTION

With the foregoing in mind, it is the principal object of this invention to provide an apparatus and method for automatically cleaning the machine frames of a pulp paper processing dryer.

It is a further object of this invention to provide an apparatus and method for cleaning the machine frames of a pulp paper processing dryer that allows for all machine frames to be cleaned in a short period of time.

An additional object of this invention is to provide an apparatus and method for cleaning the machine frames of a pulp paper processing dryer that allows for the cleaning of machine frames to be completed utilizing minimal manpower.

Another object of this invention is to provide an apparatus and method for cleaning the machine frames of a pulp paper processing dryer simultaneously after the machine frames have been taken out of service.

It is a further object of this invention to provide an apparatus and method for cleaning the machine frames of a pulp paper processing dryer that allows for machine frames to be cleaned on a more frequent basis resulting in a safe work environment and a reduction in fire hazards and paper product contamination.

An additional object of this invention is to provide an apparatus and method for cleaning the machine frames of a pulp paper processing dryer that limits the exposure of personnel to chemicals during the cleaning process.

An additional object of this invention is to provide an apparatus and method for cleaning the machine frames of a pulp paper processing dryer that adds significant fire fighting capabilities to pulp and paper dryers.

It is a further object of this invention to provide an apparatus and method for cleaning the machine frames of a pulp paper processing dryer that provides for the effective removal of oil, grease, paper fines and other contaminants from pulp and paper processing dryers.

These and other objects of the present invention are accomplished through the use of a system for cleaning the machine frames of a pulp paper processing dryer that utilizes a plurality of directional nozzles positioned adjacent to the machine frames, means for pumping cleaning solution to the directional nozzles for application onto the machine frames and protective hood, means for selectively communicating cleaning solution between the pumping means and the directional nozzles, and means for automatically controlling the operation of the cleaning system.

The paper machine drier section cleaning system utilizes a plurality of directional nozzles such as standard sprinkler heads positioned near and oriented towards the surface of machine frames so that the spray pattern from the nozzles is directed toward the machine frames. Cleaning solution is applied to the machine frames automatically and simultaneously by selectively pumping cleaning solution to the directional nozzles whereupon heated cleaning solution is sprayed onto the surface of the machine frames in a continuous application. Then the flow of cleaning solution to the directional nozzles is cutoff and warm water is pumped to the directional nozzles and applied to the surface of the machine frames to flush the machine frames.

A piping assembly connects the nozzles to a water supply pump or other source proving water at sufficient pressure, and a cleaning solution supply pump. Above the front side of the machine frames supply piping is mounted in a horizontal position. The directional nozzles are connected to the supply piping by nozzle feed piping connected to the supply piping. The length and configuration of the nozzle feed piping is predetermined to position the nozzle at a selected height and orientation relative to the front of the machine frames. The spray pattern from each directional nozzle will depend on the type of nozzle selected and its orientation relative to the machine frame to which it is directed. The spray pattern may also vary during application by using directional nozzles that move. The supply pressure of cleaning solution and water may also be varied during operation to vary the spray pattern from the directional nozzles. The front side nozzles apply cleaning solution not only to the front sides of the machine frames but also to the inside wall of the dryer hood facing the front sides of the machine frames.

Back side supply piping is mounted in a horizontal position above the back side of the machine frames. Directional nozzles are connected to the back side supply piping in the same manner as described above for front side nozzles. The spray pattern from the back side nozzles is directed to back side of the machine frames and the inside wall of the dryer hood facing the front side of the machine frames. The back side nozzles are carefully selected and position to prevent spraying cleaning solution onto the dryer cans.

For each machine frame, several nozzles may be positioned along the front side of the machine frames and several nozzles may be positioned along the back side of the machine frames. The type, number, and position of the front and back side directional nozzles directed to a machine frame will be based on the specific shape and configuration of the machine frames and dryer section equipment involved. Supply piping is positioned above the machine frames. For each machine frame, a set of directional nozzles are connected to the front and back side supply piping and the distance between sets of nozzles is determined by the distance between machine frames. A typical distance between machine frames in a pulp and paper mill is eight feet. Supply piping can be connected above the machine frames to structures supporting the machine frames or structures connected thereto such as catwalks.

As previously mentioned, a piping assembly is used to communicate cleaning solution and water from the water pump and cleaning solution pump to the nozzles. An important characteristic of this piping system is the ability to direct flow to selected banks of nozzles. The piping system will pump cleaning solution and water to all directional nozzles simultaneously or it will pump flow only to selected nozzles. A plurality of manual or automatic block valves are used to establish or prevent flow to selected nozzles as determined by the operator. The valves are positioned on the nozzle feed piping and on the supply piping. The valves may be centrally located in a valving assembly, or junction box, to readily control low to selected directional nozzles and machine frames. In addition, to simplify the operation of the cleaning system these valves may be automatically controlled from a central control unit.

The cleaning system is also comprised of a pumping means connected to a source of water. In the preferred embodiment, a source of heated water is connected to the pumping means. The water Pumping means is connected to discharge piping. In some instances, a source of heated water at elevated pressure is available, and this water may be introduced into the water discharge piping without utilization of a pumping means. Cleaning solution is injected into the water discharge piping by a cleaning solution pumping means connected to a cleaning solution supply tank. The rate of water flow and cleaning solution flow into the water discharge piping is controlled by manual or automatic flow control valves. In some instances, the cleaning solution may also be introduced into the water discharge piping by induction without the utilization of a pumping means. The water discharge piping is connected to the cleaning solution piping assembly through which cleaning solution and water are routed to the directional nozzles. The flow control valves can be set to control the ratio of water to cleaning fluid comprising the cleaning solution directed to the nozzles. In addition, flow control valves or some other control means can be used to vary the flow rates of water and cleaning solution to the nozzles during operation to vary the discharge pressures at the nozzles and the spray pattern resulting therefrom.

This invention is a significant improvement over the conventional methods used to clean pulp paper processing dryers. The present invention allows all selected machine frames to be cleaned simultaneously. As a result, pulp paper dryers can be cleaned on a more frequent basis resulting in a safer work environment. The simultaneous cleaning of machine frames can also be accomplished soon after the machine frames have been taken out of service, before the equipment has cooled and before plant personnel have begun performing maintenance on the dryers, allowing for more thorough cleaning as compared to conventional cleaning methods.

The present invention allows for the cleaning of machine frames of a pulp paper dryer automatically. The only labor involved is the labor necessary to control the cleaning system. Plant personnel controlling the operation of the cleaning system would not be exposed to chemicals and the cleaning system represents a significant reduction in the exposure of plant personnel to chemicals.

The improved cleaning system represents improved fire fighting capabilities as well as a reduction in the fire hazards. More frequent cleaning of machine frames would more frequently remove oil, grease, and paper fines accumulating on machine frames during equipment operation. The more frequent removal of these materials would reduce the risk of these materials starting or contributing to a fire. Perhaps more significantly, the cleaning system uses water and non-flammable cleaning solution so the system itself can be operated, possibly from a remote location, to assist in controlling a fire.

In addition to cleaning more quickly and with less manpower, the cleaning system cleans machine frames more thoroughly than conventional cleaning methods. Due to manpower and time constraints, conventional methods of cleaning machine frames are often limited to visible sections of the machine frames such as the front sides of the machine frames. The cleaning system would more thoroughly clean less visible back sides of machine frames, which are the sides that accumulate the most oil, grease, and paper fines during equipment operation. The cleaning method would also clean areas adjacent to and below the machine frames that come into contact with the cleaning solution. When the machine frames are flushed with water, cleaning solution is flushed from the area of the machine frames to a drainage system. The cleaning system would not only clean the machine frames but also adjacent areas contacting cleaning solution such as the sides of the dryer hood facing the machine frames, the floors, substructure, and drainage system of the pulp and paper mill.

BRIEF DESCRIPTION OF THE DRAWINGS

A system for automatically cleaning the machine frames of a pulp paper processing dryer embodying the features of the present invention is depicted in the accompanying drawings which form a portion of this disclosure and wherein.

DESCRIPTION OF THE PREFERRED EMBODIMENT

Figure 1:
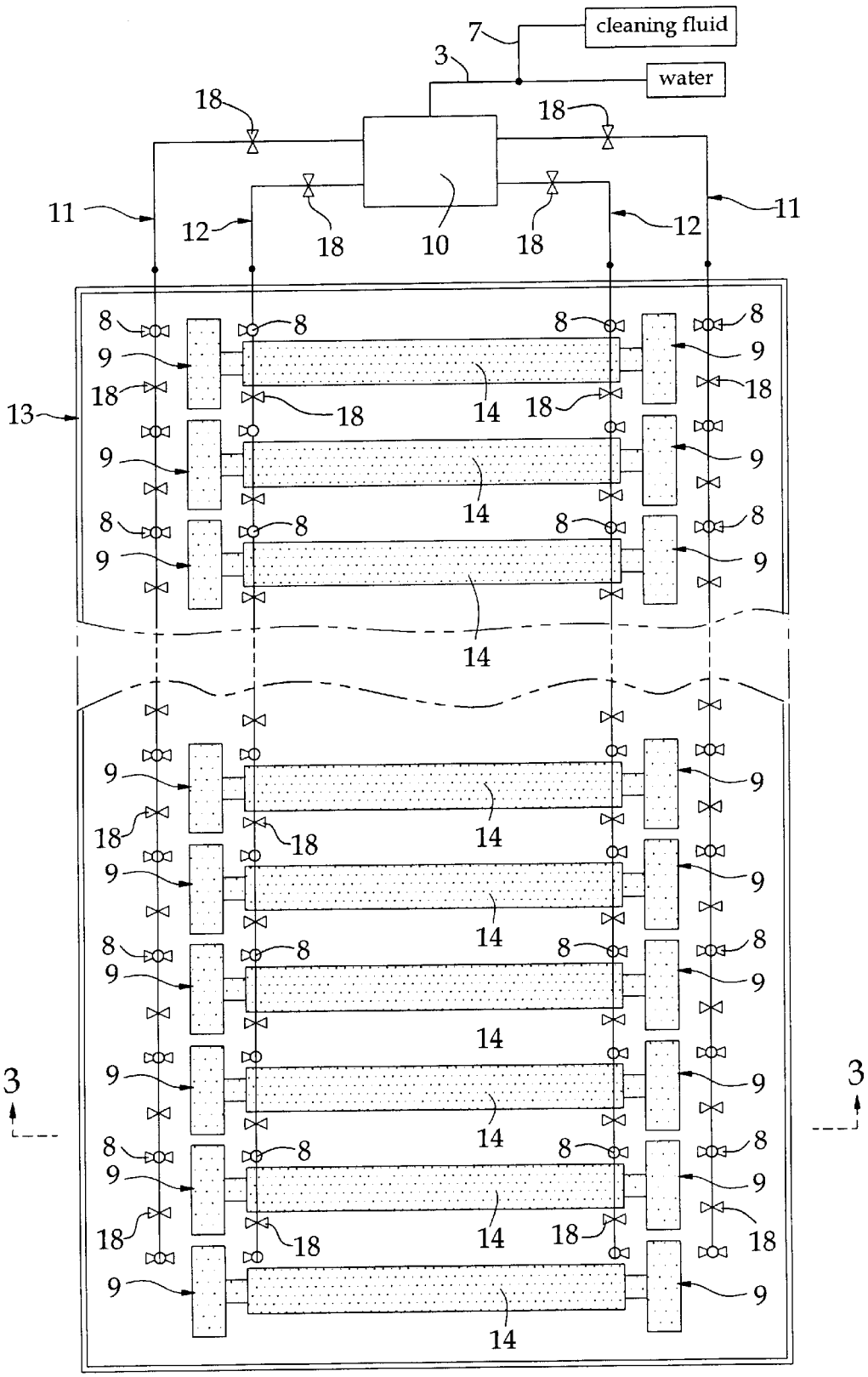
FIG. 1 is a top plan view of an embodiment of a cleaning system for a pulp paper processing dryer according to the concept of the present invention.
Figure 2:
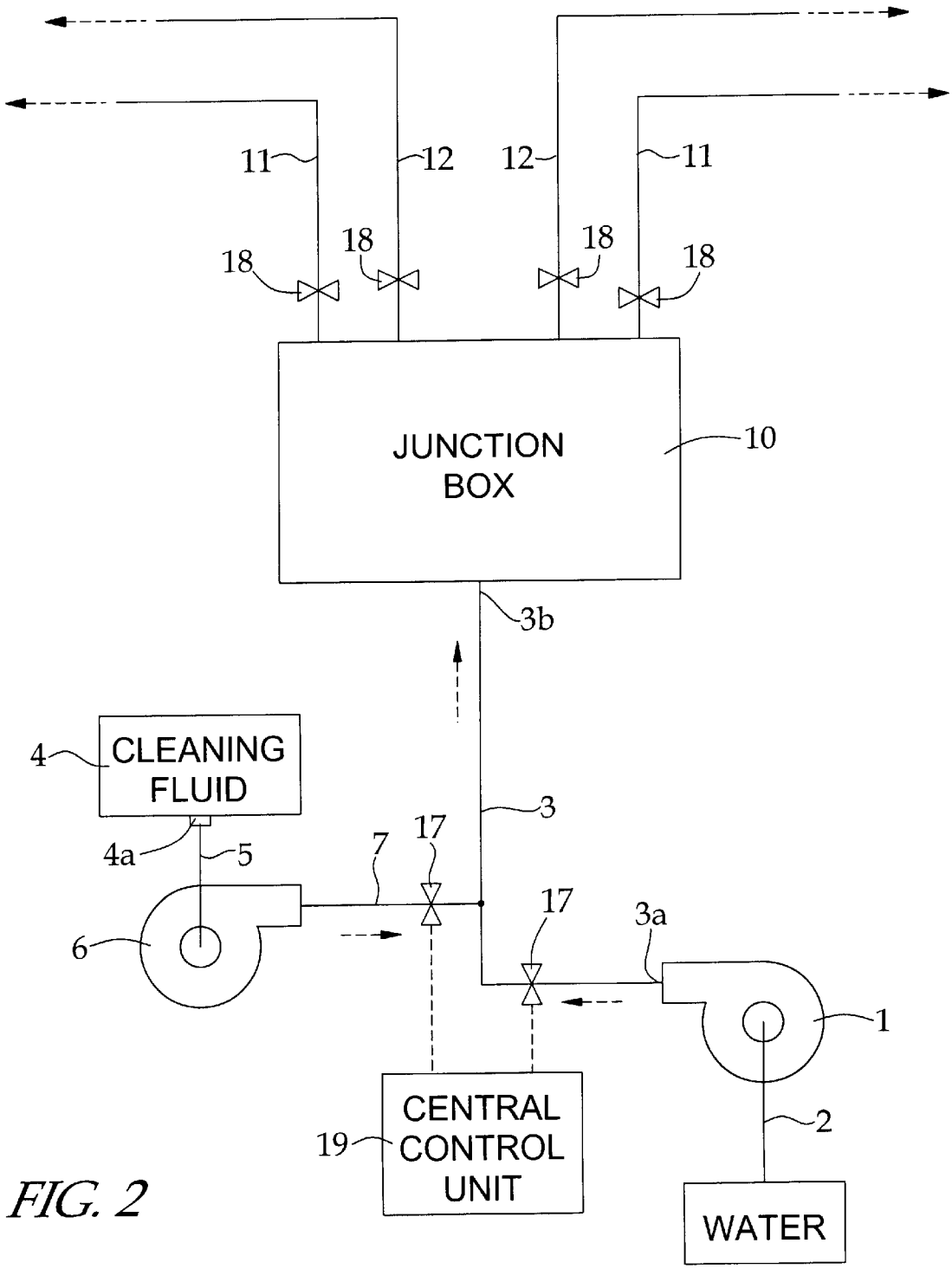
FIG. 2 is a schematic diagram of an embodiment of a cleaning system for a pulp and paper processing dryer according to the concept of the present invention.
Figure 3:
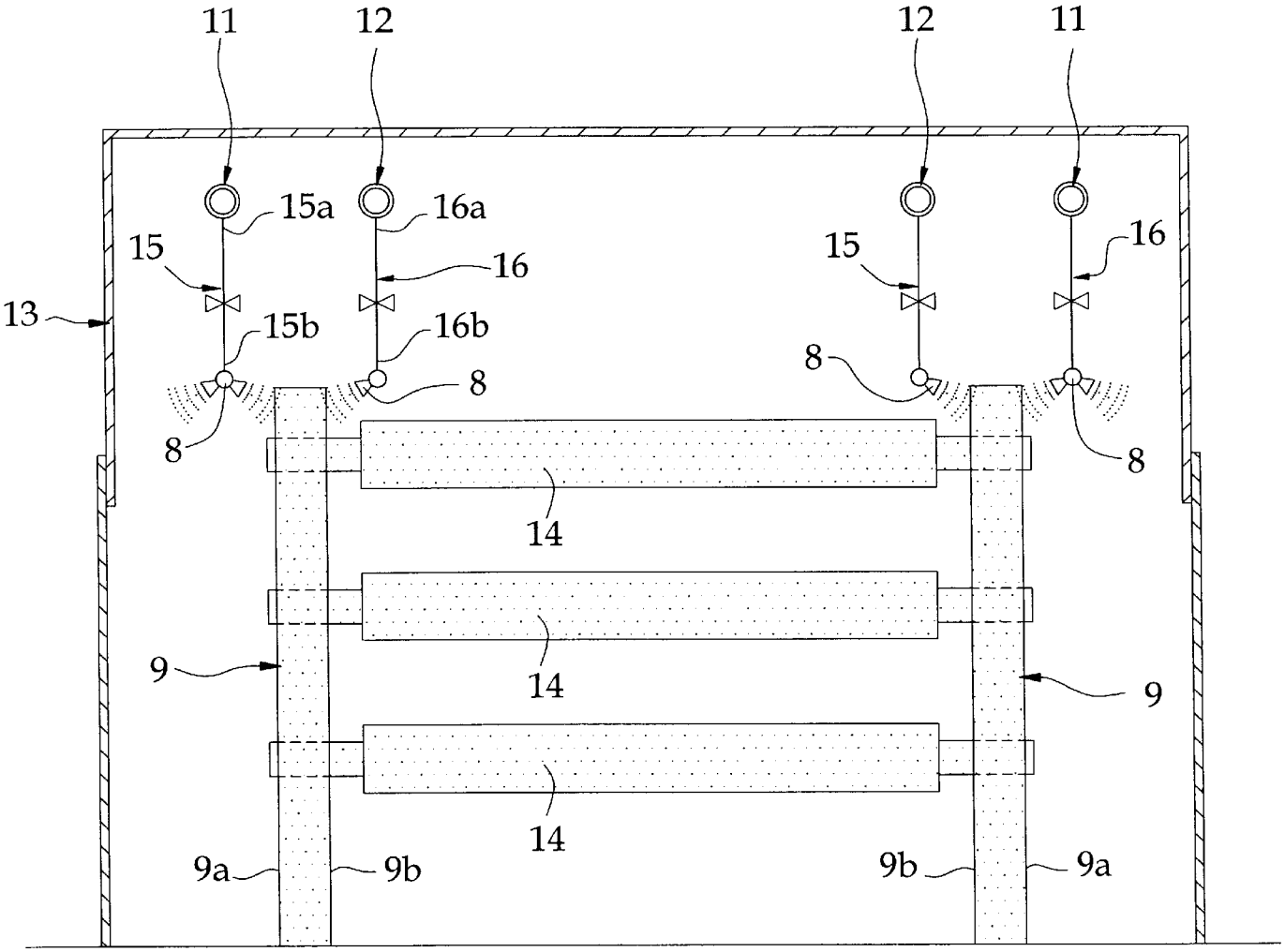
FIG. 3 is a sectional view along line 3—3 of FIG. 1 of an embodiment of a cleaning system for a pulp paper processing dryer according to the concept of the present invention.

Referring to FIGS. 1–3 for a clearer understanding of the invention, it may be seen that the preferred embodiment of the invention is comprised of a water pump 1 having a suction and a discharge. A water pump feed pipe 2 having two ends is connected at one end to a source of heated water and at the second end to the water pump suction. A water pump discharge pipe 3 having two ends 3*a*, 3*b* is connected at one end 3*a* to the water pump discharge.

In the preferred embodiment, cleaning fluid is stored in a cleaning fluid storage tank 4 having a cleaning fluid storage tank outlet 4*a*. A cleaning fluid feed pipe 5 having two ends is connected at one end to the cleaning fluid storage tank outlet 4*a* and at its second end to the suction of a cleaning fluid pump 6 having a suction and a discharge. A cleaning fluid pump discharge pipe 7 having two ends is connected at one end to the cleaning fluid pump discharge and at its second end to the water discharge pipe 3.

The second end of the water discharge pipe 3*b* is connected to a piping assembly that connects the water discharge pipe 3 with a plurality of directional nozzles 8 positioned in front of and behind a plurality of machine frames 9 having a front side 9*a* and a back side 9*b*. In the preferred embodiment, the second end of the water discharge pipe 3*b* is connected to a junction box 10 that splits the combined water and cleaning fluid flow to a plurality of machine frame front side supply pipes 11 and a plurality of machine frame back side supply pipes 12. The front side cleaning solution feed pipes 11 are secured to the structural support for the machine frames 9 in a position parallel to the front side of the machine frames 9*a* between the dryer hood 13 and the front side of the machine frames 9*a*. The back side feed pipes 12 are secured to the structural support for the machine frames in a position parallel to the back side of the machine frames 9*b* between the dyer cans 14 and the back side of the machine frames 9*b*.

A plurality of front side nozzle feed pipes 15 having two ends are connected in a vertical position with the upper end

15*a* connected to the front side cleaning solution feed pipes 11 and with its lower ends 15*b* connected to a plurality of directional nozzles 8. Similarly, a plurality of back side nozzle feed pipes 16 having two ends are connected in a vertical position with its upper ends 16*a* connected to the back side cleaning solution feed pipes 12 and with its lower ends connected to a plurality of directional nozzles 8. The directional nozzles 8 are positioned so that the spray pattern from these nozzles is directed toward the machine frames.

Controlling the flow rate of water from the water pump 1 and cleaning fluid from the cleaning fluid pump 6 are automatic flow control valves 17 located on the water discharge pipe 3 and the cleaning fluid discharge pipe 7. A plurality of manual block valves 18 are located on piping comprising the junction box 10, the front side cleaning solution feed pipes 11, the back side cleaning solution feed pipes 12, the front side nozzle feed pipes 15, and the back side nozzle feed pipes 16 to selectively direct flow of cleaning solution to feed pipes 11, 12 and directional nozzles 8. These manual block valves 18 can be set to direct flow to the selected feed pipes and directional nozzles before the cleaning system is placed into operation. In the preferred embodiment, a central control unit 19 is utilized to control the automatic flow control valves 17 for water flow rate and cleaning fluid flow rate. During operation, the flow rates of water and cleaning fluid to the nozzles 8 are varied to cause a resulting variation in the nozzle discharge pressures and spray patterns.

The preferred method of cleaning is opening all manual block valves 18, operating the water pump 1 and the cleaning fluid pump 6, spraying cleaning solution onto the surface of the machine frames 9 at a ratio of at least 1 part cleaning fluid to 50 parts water, spraying cleaning solution onto the surface of the machine frames 9 simultaneously from all directional nozzles 8 continuously for one-half hour, stopping the flow of cleaning solution to the directional nozzles 8, and spraying heated water onto the surface of the machine frames 9 simultaneously from all directional nozzles and continuously for one-half hour to flush the equipment, halting the application of water onto the machine frames 9, and allowing the surface of the machine frames 9 to dry. The preferred method further comprises varying the flow rate of cleaning solution or water to the nozzles to cause a variation in the spray pattern from the directional nozzles 8 onto the surface of the machine frames 9, and controlling the water flow rate and cleaning fluid flow rate utilizing automatic flow control valves 17 and a central control unit 19.

It is to be understood that the form of the invention described herein is a preferred embodiment thereof and that various changes and modifications may be made therein without departing from the spirit of the invention or scope as defined in the following claims.

What is claimed is:

1. A method of cleaning a plurality of machine frames of a pulp paper processing dryer, which comprises the steps of:

a. positioning a plurality of directional nozzles near and oriented toward a surface of said machine frames at selected heights relative thereto;

b. simultaneously and continuously spraying a cleaning solution from said directional nozzles onto said machine frames;

c. stopping the flow of cleaning solution to said directional nozzles;

d. simultaneously and continuously spraying water from said directional nozzles onto said machine frames;

e. halting the spraying of said water onto said machine frames; and, f. allowing said machine frames to dry.

2. A method of cleaning a plurality of machine frames of a pulp paper processing dryer as provided in claim 1 wherein said cleaning solution and said water are heated.

3. A method of cleaning a plurality of machine frames of a pulp paper processing dryer as provided in claim 2 wherein said cleaning solution is sprayed onto said machine frames at a varying flow rate and spray pattern to allow for a more complete application of said cleaning solution onto said machine frames.

4. A method of cleaning a plurality of machine frames of a pulp paper processing dryer as provided in claim 3 wherein said water is sprayed onto said surface at a varying flow rate and spray pattern.

5. A method for cleaning a plurality of vertical machine frames of a pulp paper processing dryer having a plurality of dryer doors moveable between an open position and a closed position, which comprises the steps of:

a. positioning a plurality of directional nozzles near and directed towards said vertical machine frames;

b. taking said dryer out of operation;

c. closing said dryer doors;

d. pumping water and cleaning fluid to said directional nozzles;

e. simultaneously and continuously spraying from said directional nozzles said water and said cleaning fluid onto a surface of said machine frames;

f. halting the flow of said cleaning fluid to said directional nozzles;

g. simultaneously and continuously spraying from said directional nozzles said water onto the surface of said machine frames; and h. allowing said machine frames to dry.

6. A method for cleaning a plurality of vertical machine frames of a pulp paper processing dryer as provided in claim 5 wherein said water and said cleaning fluid are heated.

7. A method for cleaning a plurality of vertical machine frames of a pulp paper processing dryer as provided in claim 6 wherein said water and said cleaning fluid are pumped to said directional nozzles at varying pressure so that the simultaneous spraying from said directional nozzles of said water and said cleaning fluid onto said machine frames is at a varying flow rate and spray pattern.

8. A method for cleaning a plurality of vertical machine frames of a pulp paper processing dryer as provided in claim 7 wherein said water is pumped to said directional nozzles at varying pressure so that the simultaneously spraying from said directional nozzles of said water onto said machine frames is at a varying flow rate and spray pattern.

* * * * *